US005079591A

United States Patent [19]

Tomita et al.

[11] Patent Number: 5,079,591

[45] Date of Patent: Jan. 7, 1992

[54] TONER CARTRIDGE WITH AN INNER SACK WHICH IS PERFORATED WHEN THE CARTRIDGE IS ISNERTED

[75] Inventors: Satoru Tomita, Yokohama; Takeshi Takemoto, Yamato; Tadaaki Kanno, Yokosuka, all of Japan

[73] Assignee: Ricoh Company, Ltd., Tokyo, Japan

[21] Appl. No.: 534,232

[22] Filed: Jun. 7, 1990

[30] Foreign Application Priority Data

Jun. 9, 1989 [JP] Japan ..... 1-147295

[51] Int. Cl.[5] ..... G03G 15/06

[52] U.S. Cl. ..... 355/260; 355/245

[58] Field of Search ..... 355/260, 245; 222/DIG. 1

[56] References Cited

U.S. PATENT DOCUMENTS

| | | | |
|---|---|---|---|
| 4,417,802 | 11/1983 | Forbes, II | 355/260 |
| 4,519,693 | 5/1985 | Skeels | 355/260 |
| 4,523,834 | 6/1985 | Pelda et al. | 355/260 |
| 4,647,180 | 3/1987 | Watanabe | 355/260 X |
| 4,660,960 | 4/1987 | Fukunaga et al. | 355/260 |
| 4,766,457 | 8/1988 | Barker et al. | 355/260 |

FOREIGN PATENT DOCUMENTS

| | | | |
|---|---|---|---|
| 0107560 | 6/1983 | Japan | 355/260 |
| 0057263 | 4/1984 | Japan | 355/260 |
| 0168469 | 9/1984 | Japan | 355/260 |
| 0029870 | 2/1986 | Japan | 355/260 |
| 0002086 | 1/1988 | Japan | 355/260 |
| 0187272 | 8/1988 | Japan | 355/260 |

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A developing apparatus operable with a toner cartridge having a flexible sack which is filled with a toner. When the toner cartridge is mounted on a developing tank included in the apparatus, the sack having been held under tension by the toner is perforated to form a hole therein. The hole causes the sack to contract rapidly due to its contactability while forcing the toner out of the sack. Then, the toner is dropped or otherwise auotmatically supplied into the developing tank. This allows the toner to be supplied without resorting to any extra manual operation after the toner cartridge has been mounted on the tank.

4 Claims, 6 Drawing Sheets

TONER CARTRIDGE WITH AN INNER SACK WHICH IS PERFORATED WHEN THE CARTRIDGE IS ISNERTED

BACKGROUND OF THE INVENTION

The present invention relates to a developing apparatus for electrophotographic image forming equipment and, more particularly, to a developing apparatus of the type supplying a toner from a toner cartridge into a developing tank.

Generally, an electrophotographic copier, printer, facsimile machine or similar electrophotographic image forming apparatus forms a latent image representative of a document electrostatially on image carrier such as a photoconductive element. A toner carrier in the form of a developing roller, for example, is incorporated in the developing apparatus and supplies a developer, or toner, to the latent image to turn it into a toner image. A toner cartridge storing a fresh toner therein is removably or replaceably mounted on the developing tank so as to supply the toner into the tank. When the toner in the developing tank becomes scarce, the toner cartridge is replaced with a new toner cartridge. In the event of replacement of such a toner cartridge, the toner is apt to smear the operator's hands. To protect the operator's hands from smearing, there may be used a device which pushes out a toner from a toner cartridge into the developing tank, as disclosed in Japanese Utility Model Laid-Open Publication (Kokai) Nos. 23053/1989 and 24350/1989 by way of example.

The problem with the prior art approaches mentioned above is that they necessarily rely on some extra manual operation in supplying a toner from a toner cartridge into the developing tank. Specifically, the approach of Laid-Open Publication No. 23053/1989 is not practicable unless the operator rotates a toner pushing member by hand, while the approach of Laid-Open Publication No. 24350/1989 forces operator to cut a seal member while pressing a generally H-shaped member against the seal member.

SUMMARY OF THE INVENTION

It is therefore an object of the present invention to provide a developing apparatus which frees a person from extra operations for toner supply after a toner cartridge has been mounted.

It is another object of the present invention to provide a developing apparatus which simplifies means for positioning a toner cartridge in a developing tank.

It is another object of the present invention to provide a generally improved developing apparatus for image forming equipment.

A developing apparatus operable with a toner cartridge having a flexible sack which is filled with a toner of the present invention comprises a developing tank on which the toner cartridge is removably mounted, and a perforating member for forming, when the toner cartridge is mounted on the developing tank, a hole in the sack to supply the toner into the developing tank via the hole.

BRIEF DESCRIPTION OF THE DRAWINGS

The above and other objects, features and advantages of the present invention will become more apparent from the following description taken with the accompanying drawings in which.

In the figures, the same or similar components and structural elements are designated by like reference numerals, and redundant description will be avoided for simplicity.

DESCRIPTION OF THE PREFERRED EMBODIMENTS

First Embodiment

Figure 1:
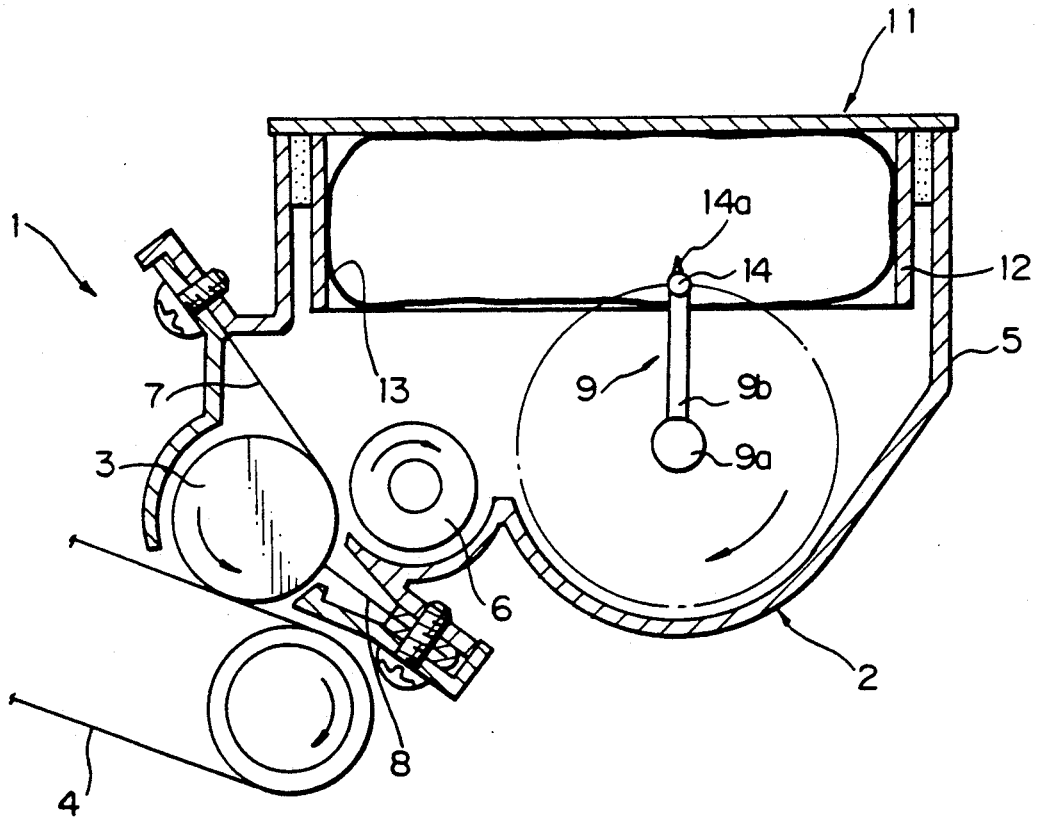
FIG. 1 is a vertical section showing a first embodiment of the developing apparatus in accordance with the present invention.

Referring to FIG. 1 of the drawings, a developing apparatus embodying the present invention is shown and generally designated by the reference numeral 1. The apparatus 1 has a developing unit 2 in which a toner carrier in the form of a developing roller 3 is rotatably accommodated. In a predetermined developing region, the developing roller 3 elastically contacts the surface of a photoconductive element which is implemented as a belt 4. The belt 4 and roller 3 are driven to move in the same direction in the region where they contact each other, as indicated by arrows in the figure.

In the developing unit 2, a developing tank 5 is disposed to serve as a toner storing section. A toner supply roller 6 is positioned in the tank 5 for supplying a fresh toner to the surface of the developing roller 3. A blade 7, a discharging brush 8 and an agitator 9 are also disposed in the tank 5. The blade 7 regulates the thickness of the toner deposited on the surface of the developing roller 3 to form a thin toner layer. The discharging brush 8 removes the charge and toner which remain on the surface of the developing roller 3 after development. The agitator 9 drives the toner stored in the tank 5 toward the toner supply roller 6 while agitating it. These members 6 to 9 each is rotated in a particular direction as indicated by an arrow.

In operation, the surface of the belt 4 is uniformly charged and then exposed to image light representative of a document with the result that a latent image is formed electrostatically thereon. The developing roller 3 selectively feeds the toner to the latent image in the developing region, whereby the latent image is developed to become a toner image. In a predetermined developer supply region, the toner supply roller 6 supplies a fresh toner from the developing tank 5 to the developing roller 3. The toner deposited on the developing roller 3 is transported to the developing region while being regulated to a predetermined thickness by the blade 7.

Figure 2:
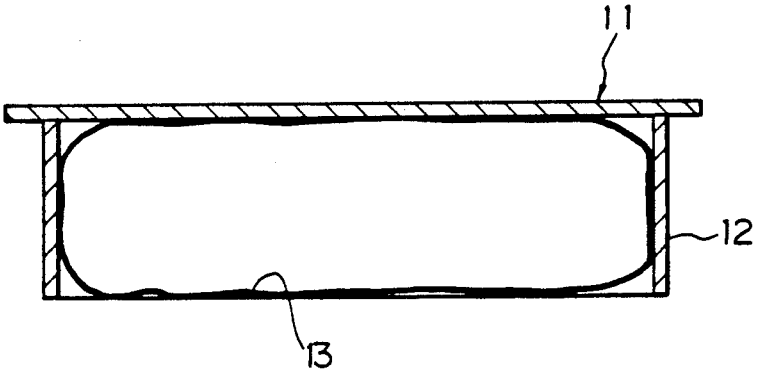
FIGS. 2 and 3 are vertical sections of a toner cartridge for use with the illustrative embodiment shown in FIG. 1.

In the illustrative embodiment, a toner cartridge 11 filled with a fresh toner is removably or replaceably mounted on the developing tank 5, so that the toner may be fed from the cartridge 11 to the tank 5. As also shown in FIG. 2, the toner cartridge 11 has a casing 12 accommodating therein a sack 13 which is made of rubber or similar flexible material. The sack 13 is filled with a fresh toner and affixed by adhesive to the inner periphery of the upper wall of the casing 12 as viewed in the figures. So long as the flexible sack 13 is filled with the fresh toner, it is held under tension by the toner.

Figure 3:
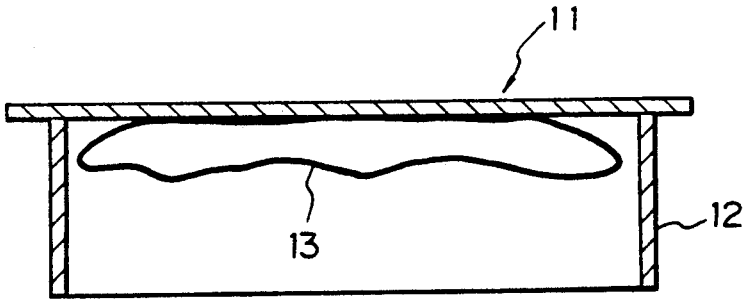

The agitator 9 has a shaft 9a and a blade 9b which extends radially outward from the shaft 9a by a predetermined amount. A projection 14 is provided on the radially outermost end of the blade 9b and plays the role of means for perforating the sack 13. Specifically, the projection 14 has a radially outwardly extending needle portion 14a. The needle portion 14a is positioned such that the tip thereof is capable of contacting the sack 13. In this configuration, when the toner cartridge 11 is mounted on the developing tank 3, the tip of the needle portion 14a contacts and penetrates the sack 13 and thereby forms a hole in the sack 13. As soon as the needle portion 14 penetrates the sack 13 as mentioned, the sack 13 having been held under tension contracts rapidly due to its inherent contractibility, as shown in FIG. 3. While so contracting, the sack 13 forces the fresh toner out of it. The toner forced out of the sack 13 is dropped or otherwise automatically fed into the developing tank 5. The fresh toner, therefore, can be supplied without resorting to any extra manual operation for toner supply.

Second Embodiment

Figure 4:
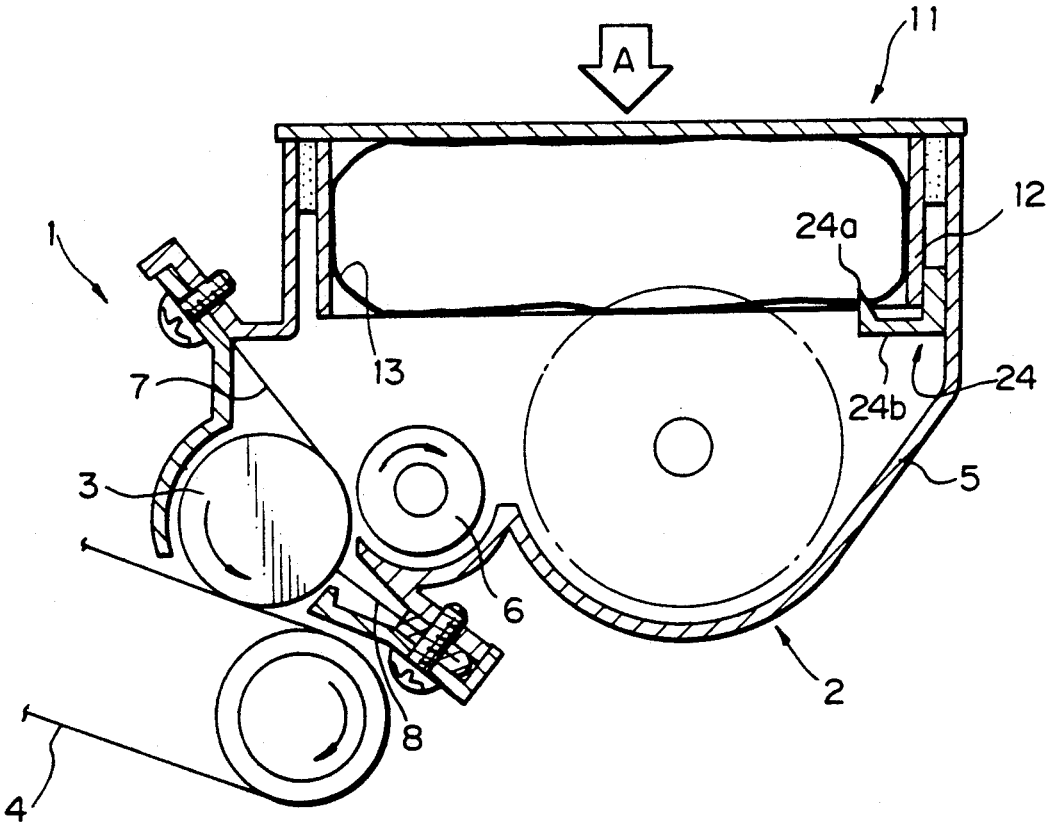
FIG. 4 is a vertical section showing a second embodiment of the present invention.

FIG. 4 shows an alternative embodiment of the present invention. As shown, a projection 24 is provided on the inner periphery of the developing tank 5 which accommodates the toner cartridge 11. The projection 24 serves two different functions at the same time, i.e., a function of perforating the sack 13 and a function of positioning the toner cartridge 11 in a predetermined position. Specifically, the projection 24 has a support portion 24b extending substantially horizontally from the inner periphery of the tank 5 as viewed in FIG. 4, and a needle portion 24a extending upward from the free end of support portion 24b as viewed in FIG. 4. When the toner cartridge 11 is mounted on the developing tank 5, the underside of the cartridge casing 12 rests on the support portion 24b and is thereby held in a predetermined position. The needle portion 24a is positioned such that the tip thereof contacts the sack 13. Therefore, when the toner cartridge 11 is mounted on the tank 5, the tip of the needle portion 24a contacts and performate the sack 13.

Assume that the toner cartridge 11 is mounted on the developing tank 5, as indicated by an arrow A in FIG. 4. Then, the underside of the cartridge casing 12 rests on the support portion 24b of the projection 24, so that the toner cartridge 11 is located in a predetermined position. At the same time, the tip of the needle portion 24a of the projection 24 contacts and penetrates the sack 13 which has been held under tension by the toner. As soon as the needle portion 14 perforates the sack 13 by penetrating it, the sack 13 contracts rapidly due to its contractibility, as shown in FIG. 3. While so contracting, the sack 13 forces the fresh toner out of it. The toner forced out of the sack 13 is dropped or otherwise automatically fed into the developing tank 5. The fresh toner, therefore, can be supplied without resorting to any extra manual operation for toner supply.

In this particular embodiment, the perforating means and the positioning means are implemented by a single member. This is successful in minimizing the increase in the number of parts.

Third Embodiment

Figure 5A:
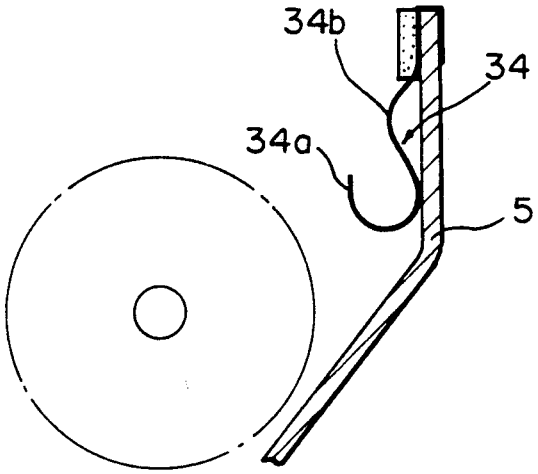
FIGS. 5A, 5B, 6A, 6B, 7A and 7B are fragmentary sections showing a third to fifth embodiments of the present invention.
Figure 5B:
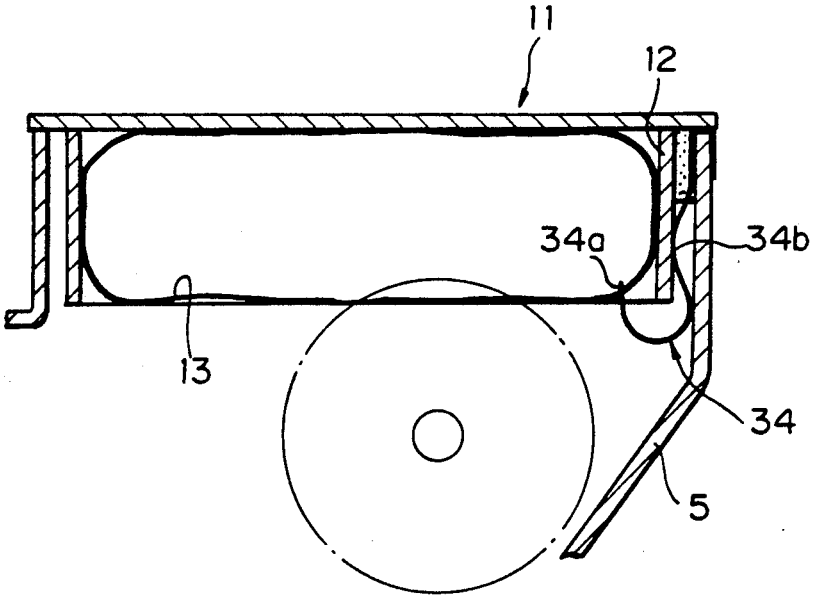

FIGS. 5A and 5B show another alternative embodiment of the present invention. In the figures, the same or similar components and structural elements are designated by like reference numerals. As shown, a projection 34 is provided on the inner periphery of the developing tank 5 in such a manner as to hang down from the upper edge of the tank 5. The projection 34 functions as both a means for perforating the sack 13 and a means for positioning the toner cartridge 11. Specifically, the projection 34 has a generally hook-like configuration, i.e., it has an arm portion or support portion 34b curved substantially horizontally away from the inner periphery of the tank 5 as viewed in the figures, and an upwardly extending needle portion 34a into which the curved support portion 34b merges. When the toner cartridge 11 is mounted on the developing tank 5, the support portion 34b presses itself against the outer periphery of the cartridge casing 12 and holds the latter in a predetermined position by friction. The needle portion 34a is positioned such that the tip thereof contacts the sack 13 when the toner cartridge 11 is mounted on the tank 5. On contacting the sack 13, the needle portion 34a perforates the sack 13. The projection 34 may be implemented by resilient metal or plastic or similar elastic material.

The third embodiment shown and described are comparable with the second embodiment concerning the operation and advantages.

Fourth Embodiment

Figure 6A:
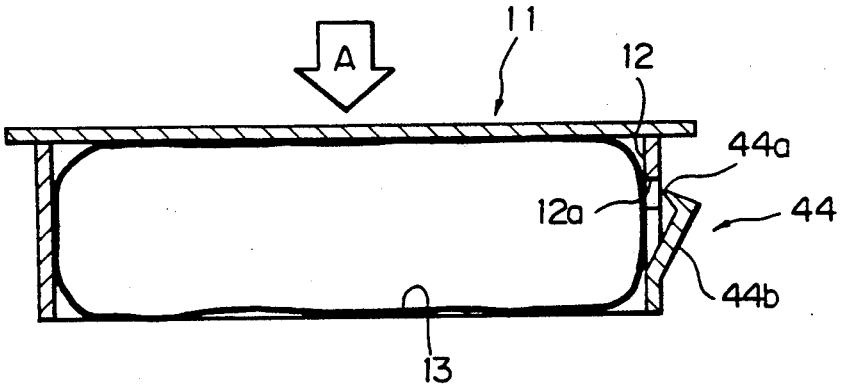
Figure 6B:
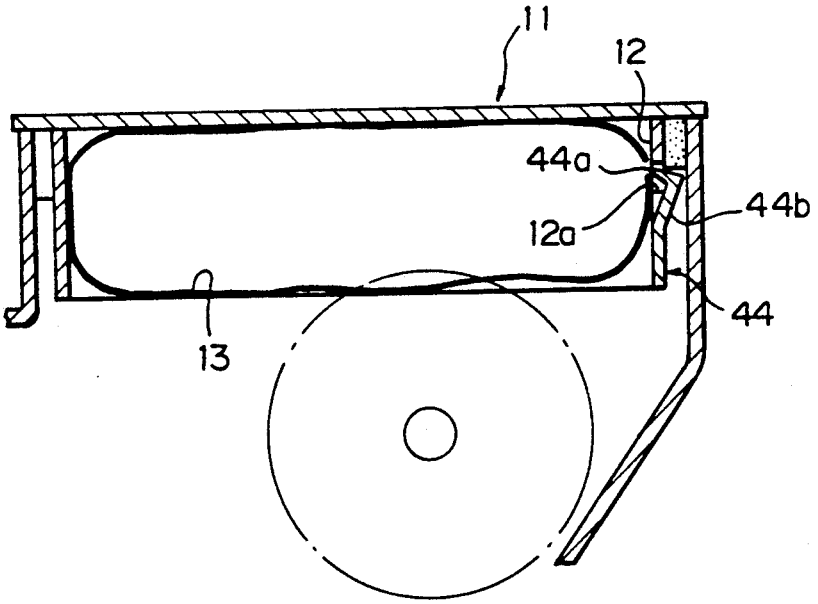

FIGS. 6A and 6B show another alternative embodiment of the present invention. As shown, a projection 44 is provided on the toner cartridge 11 for perforating the sack 13. Specifically, the projection 44 is positioned on one side wall of the cartridge casing 12 and protrudes obliquely upward and rightward as viewed in the figures, i.e., in the opposite direction to the direction A in which the toner cartridge 11 is inserted in the developing tank 5. A needle portion 44a extends out from the free end of the projection 44 toward the interior of the toner cartridge 11 and substantially perpendicularly to the projection 44. The intermediate portion or arm portion of the projection 44 protrudes toward the side wall of the cartridge casing 12, whereby a support portion 44b for positioning the toner cartridge 11 is formed. When the toner cartridge 11 is mounted on the developing tank 5, the support portion 44b is pressed against the inner periphery of the tank 5 and, hence, the cartridge 11 is held in a predetermined position by the friction of the support portion 44b with the tank 5. The projection 44 is made of a plastic or similar elastic material so that it may be urged toward the side wall of the cartridge casing 12 by an external force. The projection 44 may be formed integrally with the cartridge casing 12 or may be implemented as a separate member and affixed to the latter.

An opening 12a is formed throughout the side wall of the cartridge casing 12 for receiving the needle portion 44. When the projection 44 is urged toward the side wall of the cartridge casing 12 by an external force, the tip of the needle portion 44a contacts the sack 13 through the opening 13a.

When the toner cartridge 11 is mounted on the developing tank 5 as indicated by the arrow A in FIG. 6A, the projection 44 is urged by the inner periphery of the tank 5 to the position shown in FIG. 6B. Then, the tip of the needle portion 44*a* of the projection 44 contacts and penetrates the sack 13 via the opening 12*a*, forming a hole in the sack 13. The hole causes the sack 13 having been held under tension to contract rapidly, as shown in FIG. 3. As a result, the fresh toner stored in the sack 13 is forced out of the sack 13 and then dropped or otherwise supplied into the developing tank 5. This is successful in eliminating the need for an extra manual operation. It is noteworthy that the projection 44 serving as perforating means is provided on the toner cartridge 11 which is disposable. The projection 44, therefore, needs only a simple structure which withstands a single service, while the perforating means which is replaced together with the toner cartridge 11 insures high reliability.

Fifth Embodiment

Figure 7A:
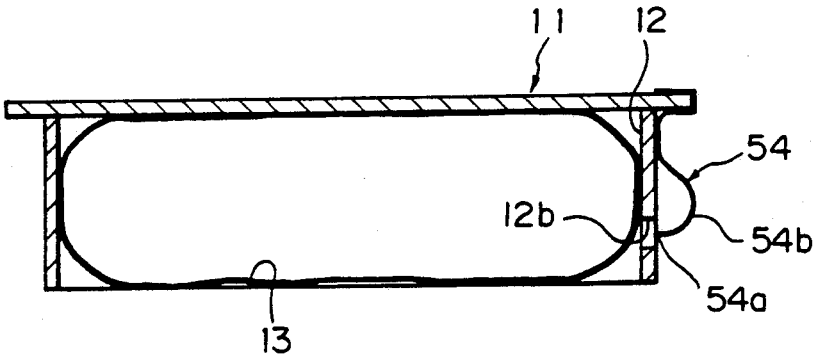
Figure 7B:
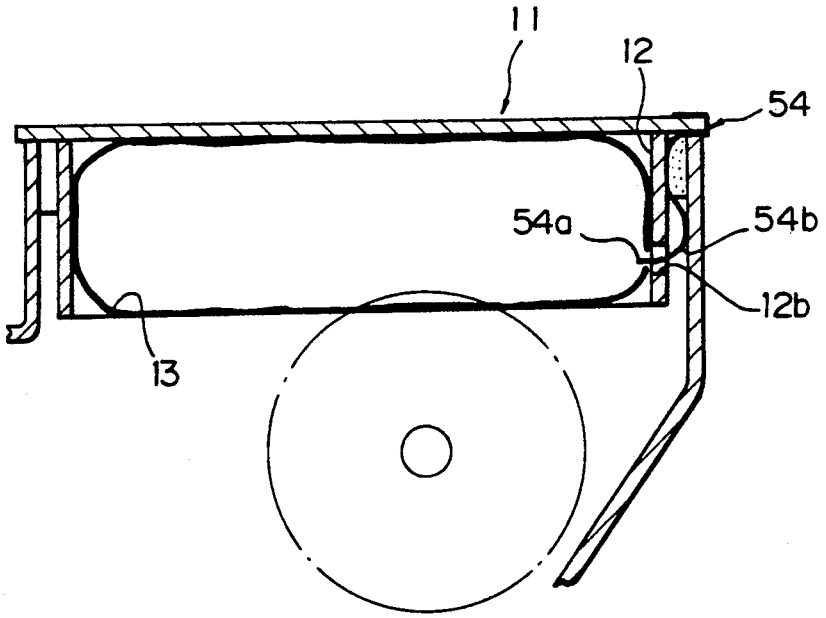

FIGS. 7A and 7B shows another alternative embodiment of the present invention. As shown, a projection 54 serving as perforating means and positioning means at the same tme is provided on the toner cartridge 11. Having a generally hook-like configuration, the projection 54 hangs down from the upper edge of the cartridge casing 12 along the side wall of the casing 12. The projection 54 has an arm portion which is curved outwardly away from the side wall of the cartridge casing 12 in the horizontal direction as viewed in the figures, thereby forming a support portion 54*b* for positioning the toner cartridge 11. When the toner cartridge 11 is mounted on the developing tank 5, the support portion 54*b* is pressed against the inner periphery of the tank 5 and thereby fixes the cartridge 11 in a predetermined position by friction. The support portion 54*b* merges into a needle portion 54*a* which protrudes upward as viewed in the figures. The needle portion 54*a* is positioned such that the tip thereof contacts the sack 13 when the toner cartridge 11 is inserted in the tank 5.

Made of an elastic material, the projection 54 is urged by an external force toward the side wall of the cartridge casing 12 on the insertion of the cartridge 11 in the developing tank 5. An opening 12*b* is formed throughout the side wall of the cartridge casing 12 for receiving the needle portion 54*a*. As shown in FIG. 7B, when the projection 54 is urged by an external force, the tip of the needle portion 54*a* is brought into contact with the sack 13 via the opening 12*b*.

The embodiment of FIGS. 7A and 7B achieves the same advantages as the embodiment of FIGS. 6A and 6B.

It is to be noted that while the illustrative embodiments have been shown and described in relation to a developing apparatus, the present invention is similarly applicable to various kinds of powder supplying apparatuses with which powder cartridges are usable.

In summary, it will be seen that the present invention provides a developing apparatus which frees a person from extra manual operations otherwise needed to supply a toner after mounting a toner cartridge and thereby protects the person's hands from smearing. This advantage is derived from the fact that when a toner cartridge is inserted in a developing tank, perforating means form a hole in a toner sack to cause a toner to be forced out of the sack.

The perforating means and positioning means which fixes a toner cartridge in place in a developing tank are implemented by a single member. This minimizes the increase in the number of parts and thereby further promotes the simplification of the positioning means.

Various modifications will become possible for those skilled in the art after receiving the teachings of the present disclosure without departing from the scope thereof.

What is claimed is:

1. A developing apparatus operable with a toner cartridge having a flexible sack which is fitted with a toner, comprising:

a developing tank on which the toner cartridge is removably mounted, said toner cartridge comprising a casing having a side wall with an opening; and means for perforating and positioning said toner cartridge when said toner cartridge is mounted on said developing tank, said perforating and positioning means being integrally located on said toner cartridge casing and being movable from a first non-perforating and non-positioning position to a second position, when said toner cartridge is mounted on said developing tank, in which a portion of said perforating and positioning means extends through said opening to form a hole in the sack in order to supply the toner into said developing tank via said hole and position the toner mounted on said developing tank in a predetermined position;

wherein, when said toner cartridge is mounted on said developing tank, said perforating and positioning means is urged to said second position by the inner periphery of said developing tank to form said hole and said toner cartridge is held in said predetermined position by friction created between said perforating and positioning means and said developing tank.

2. The developing apparatus as claimed in claim 1, wherein said perforating and positioning means defines an arm portion which extends obliquely upward from an outer periphery of said casing in said first position, and a needle portion which protrudes from a free end of said arm portion toward the interior of said casing and substantially perpendicular to said arm portion in a direction toward said opening, such that when said perforating and positioning means is in said second position, said needle portion extends through said opening to form said hole.

3. The developing apparatus according to claim 1, wherein said perforating and positioning means defines a curved portion extending downward from an upper edge of an outer periphery of said casing and along said upper periphery, and a needle portion extending substantially horizontally from a free end of said curved portion toward the interior of said toner cartridge, such that when said perforating and positioning means is in said second position, said needle portion extends through said opening to form said hole.

4. The developing apparatus according to claim 1, wherein said perforating and positioning means is comprised of an elastic material.

* * * * *